US006918714B2

(12) United States Patent
Chambard

(10) Patent No.: US 6,918,714 B2
(45) Date of Patent: Jul. 19, 2005

(54) METHOD AND VEHICLE FOR PAVEMENT SURFACE DRESSING

(75) Inventor: Pierre Chambard, Saint-Marcellin (FR)

(73) Assignee: Secmair, Cosse le Vivien (FR)

( * ) Notice: Subject to any disclaimer, the term of this patent is extended or adjusted under 35 U.S.C. 154(b) by 0 days.

(21) Appl. No.: 10/468,960

(22) PCT Filed: Feb. 21, 2001

(86) PCT No.: PCT/FR01/00506

§ 371 (c)(1),
(2), (4) Date: Aug. 16, 2004

(87) PCT Pub. No.: WO02/066744

PCT Pub. Date: Aug. 29, 2002

(65) Prior Publication Data

US 2005/0031413 A1 Feb. 10, 2005

(51) Int. Cl.[7] ..... E01C 19/00

(52) U.S. Cl. ..... 404/82; 404/90; 404/111; 404/27

(58) Field of Search ..... 404/27, 82, 90, 404/111; 427/138; 239/172

(56) References Cited

U.S. PATENT DOCUMENTS

| | | | | | |
|---|---|---|---|---|---|
| 4,817,870 | A | * | 4/1989 | Dalton | 239/157 |
| 5,957,619 | A | * | 9/1999 | Kinoshita et al. | 404/31 |
| 6,454,183 | B1 | * | 9/2002 | Hedegaard | 239/172 |
| 6,565,281 | B2 | * | 5/2003 | Bruns et al. | 404/90 |
| 6,712,895 | B1 | * | 3/2004 | Hoad | 106/122 |

FOREIGN PATENT DOCUMENTS

| | | | | |
|---|---|---|---|---|
| FR | 0283399 A1 | * | 3/1988 | E01C/19/17 |
| FR | 2800104 A | * | 10/1999 | E01C/19/21 |

* cited by examiner

*Primary Examiner*—Thomas Will
*Assistant Examiner*—Raymond W Addie
(74) *Attorney, Agent, or Firm*—Blakely Sokoloff Taylor & Zafman

(57) ABSTRACT

According to the invention, the surface is dressed by synchronous spreading of binder and gravel on the pavement as follows: a) a first layer of hot bitumen ($b_1$) having a temperature greater than 100° C. is spread on the pavement (S): b) a film of hot water (e) is spread on top of said first layer, c) a second layer of hot bitumen ($b_2$) having a temperature greater than 100° C. is spread on top of said film of hot water; d) a layer of gravel c) is spread on top of all of the above. Pavement dressing.

5 Claims, 2 Drawing Sheets

METHOD AND VEHICLE FOR PAVEMENT SURFACE DRESSING

The present invention relates to a method and a machine for applying a surface coating by the synchronous spreading of bonding agent and chippings onto a roadway.

By "synchronous spreading" will be understood in the present description, as well as in the claims which follow, a single action spreading, with the chippings being spread immediately, as quickly as possible, after the spreading of the bitumen, with the result that the chippings are laid into a hot bonding agent, the temperature of which is practically the same as that at which it is kept on the spreading machine.

To spread synchronously, a lorry type vehicle is traditionally used with a chassis bearing a hot bitumen tank and a tipper containing the chippings, this vehicle being fitted with a boom for dispensing bitumen onto the roadway which is placed in front—considering the vehicle's forward operational movement—of a chipping spreader device.

A vehicle of this kind, usually called a "bi-spreader", is for example, marketed by the applicant company under the commercial name "CHIPSEALER".

The objective of the present invention is to propose a method for applying the surface coating which, while being simple to implement, makes it possible to obtain, on the one hand a good adhesion of the coating on the road surface, on the other hand improved cohesion of the coating, and in particular a particularly effective anchoring of the chippings within the layer of bonding agent.

This objective is reached, in accordance with the invention, by operating in the following way:

a) a first layer of hot bitumen with a temperature above 100° C. in spread onto the roadway;

b) onto this first layer is deposited a film of hot water;

c) onto this film of hot water is spread a second layer of hot bitumen, with a temperature above 100° C.;

d) over the whole thing is spread a layer or chippings.

Furthermore according to a certain number of additional characteristics, which do not restrict the invention:

bitumen taken to a temperature close to 130° C. and water taken to a temperature close to 100° C. are used;

the chippings are spread less than two seconds and, preferably, leer than one second after the second layer of bitumen is spread;

the total spreading time is less than about four seconds.

The vehicle for applying a surface coating by synchronous spreading of bonding agent onto a roadway, which is also the subject of the present invention, comprises a chassis bearing a hot bitumen tank and a tipper containing chippings, this vehicle being fitted with a first boom for dispensing hot bitumen onto the roadway, which is placed in front—considering the vehicle's forward operational movement—of a chipping spreader device.

This vehicle is remarkable in that the chassis additionally bears a hot water tank, the vehicle being fitted additionally with a second boom for dispensing hot bitumen, also placed in front of said chipping spreader device, and with a hot water spray boom placed between the two bitumen dispensing booms.

Other characteristics and advantages of the invention will emerge from the description and from the appended drawings, in which FIGS. 1 to 3 are diagrams illustrating the method of the invention, while FIG. 4 is a diagrammatic side view of the vehicle used to implement the process.

In FIG. 1 has been shown diagrammatically the method of coating a roadway S, by synchronous spreading of bonding agent and chippings.

In this Figure two bonding agent dispensing booms have been denoted by the reference numbers 1 and 3.

These two booms extend parallel to each other, transversally relative to the roadway.

In a known way, each of the booms is composed of a plurality of spray nozzles located side-by-side in the transverse direction, each able to emit a conical jet, each jet covering the neighbouring jet in such a way as to ensure a homogeneous distribution of the bonding agent sprayed onto the roadway.

The direction of forward movement of the spreading system is denoted by the arrow F.

Between the two booms 1 and 3 is inserted a device for spraying hot water e on the roadway, with the reference number 2, and symbolised by a watering can.

This device may also be constituted in practice by a set of juxtaposed nozzles which spray the water in the form of fine droplets according to a homogeneous distribution.

To the rear of the spreading assembly 1-2-3, the chippings c are deposited by gravity, with one of them being shown as it falls.

Booms 1 and 3 are adapted to spray onto the roadway hot bitumen $b_1$ and $b_2$ respectively; the temperature of the bitumen is preferably about 130° C.

The temperature of the hot water is close to 100° C.

The volume of water e deposited is very markedly smaller than the volumes of bitumen $b_1$ and $b_2$.

The quantities of bitumen $b_1$ and $b_2$ supplied by each of the booms 1 and 3 are advantageously the same or close to each other.

These quantities are naturally dependent on the thickness of the coating layer it is desired to apply, a thickness to which the particle size distribution of the chippings used is also adapted.

The bitumen $b_1$ forms a first layer, the main function of which is to anchor the new layer to the surface S being treated; the bitumen $b_1$ will particularly fill in cracks or other irregularities in the surface of the roadway.

The film of water e is covered, immediately after it has been sprayed onto the first layer, by the equally hot bitumen $b_2$ of the second layer.

Since the water is also hot, close to its boiling point, micro-bubbles of foaming water vapour can be instantly seen to form, causing a significant and quasi-instantaneous expansion of the mix.

The layer of chippings c is therefore embedded into a foamy and expanded bonding agent.

A comparison or these two figures reveals that the chippings are much more fully embedded in the second case.

Figure 1:
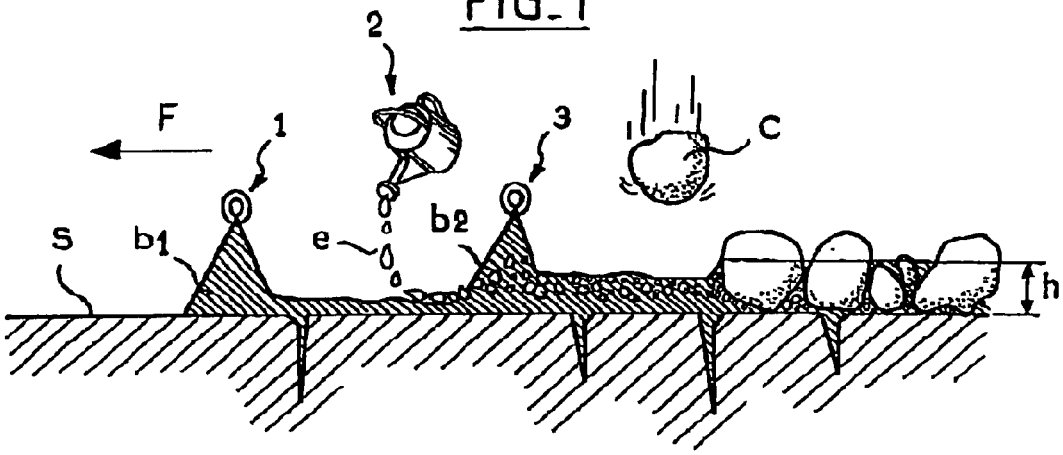
Figure 2A:
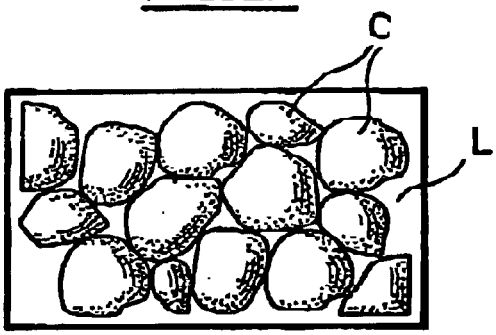
FIG. 2A is a diagrammatic view from above showing a layer of chippings that has just been deposited into a standard bonding agent L.
Figure 2B:
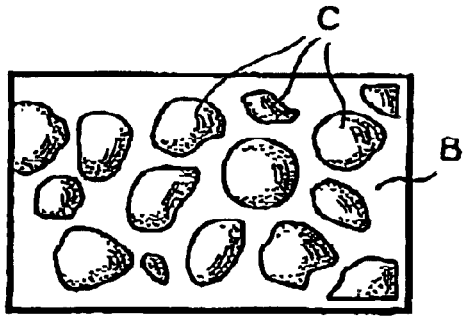
FIG. 2B is a similar view showing the layer of chippings deposited in the expanded bitumen B applied in accordance with the invention.
Figure 3A:
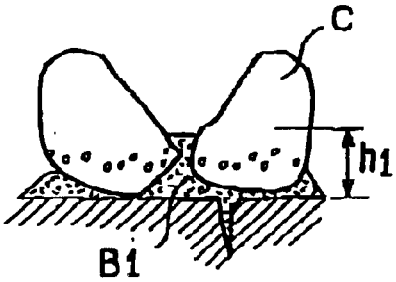
Figure 3B:
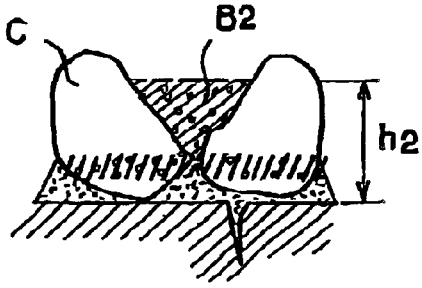

In practice, the expansion of the bitumen in the upper layer occurs very fast and continues to occur after the chippings c have been deposited, as is shown in FIGS. 3A and 3B.

In FIG. 3A the position is shown just at the moment the chippings are deposited into the expanding bitumen, denoted $b_1$; the height of the bitumen layer is denoted $h_1$.

The water caught in the two layers of bitumen is converted very rapidly into steam, continuing to expand and more exactly to expand the upper layer in the intervals separating the different chippings to reach a height $h_2$ substantially greater than $h_1$, such that the entire lower portion as well as the central part of each chipping is coated within the bonding agent.

After the water has evaporated this height can be seen to go down; however the bitumen retains an extensive contact with the chippings by forming a meniscus helping them to get fully anchored into the layer of bitumen, even after this has cooled and the water which it contained has evaporated.

A remarkable adhesion of the layer is thus obtained relative to the road surface S together with a firm anchoring of the chippings within this layer.

The two bitumens $b_1$ and $b_2$ are not necessarily identical in composition or quality.

To implement the method it is important for the different subsequent spreading operations, namely the spreading of bitumen $b_1$, the spreading of the water and the spreading of the bitumen $b_2$ and the spreading of the chippings c to be carried out one after the other in quick succession.

Thus, the chippings are spread to advantage lose than 2 seconds after the spreading of the second bitumen layer and preferably less than one second after this spreading.

The total spreading time, between the spreading of the first layer $b_1$ and the spreading of the chippings c is preferably less than about 4 seconds, it is for example about 2 seconds.

Figure 4:
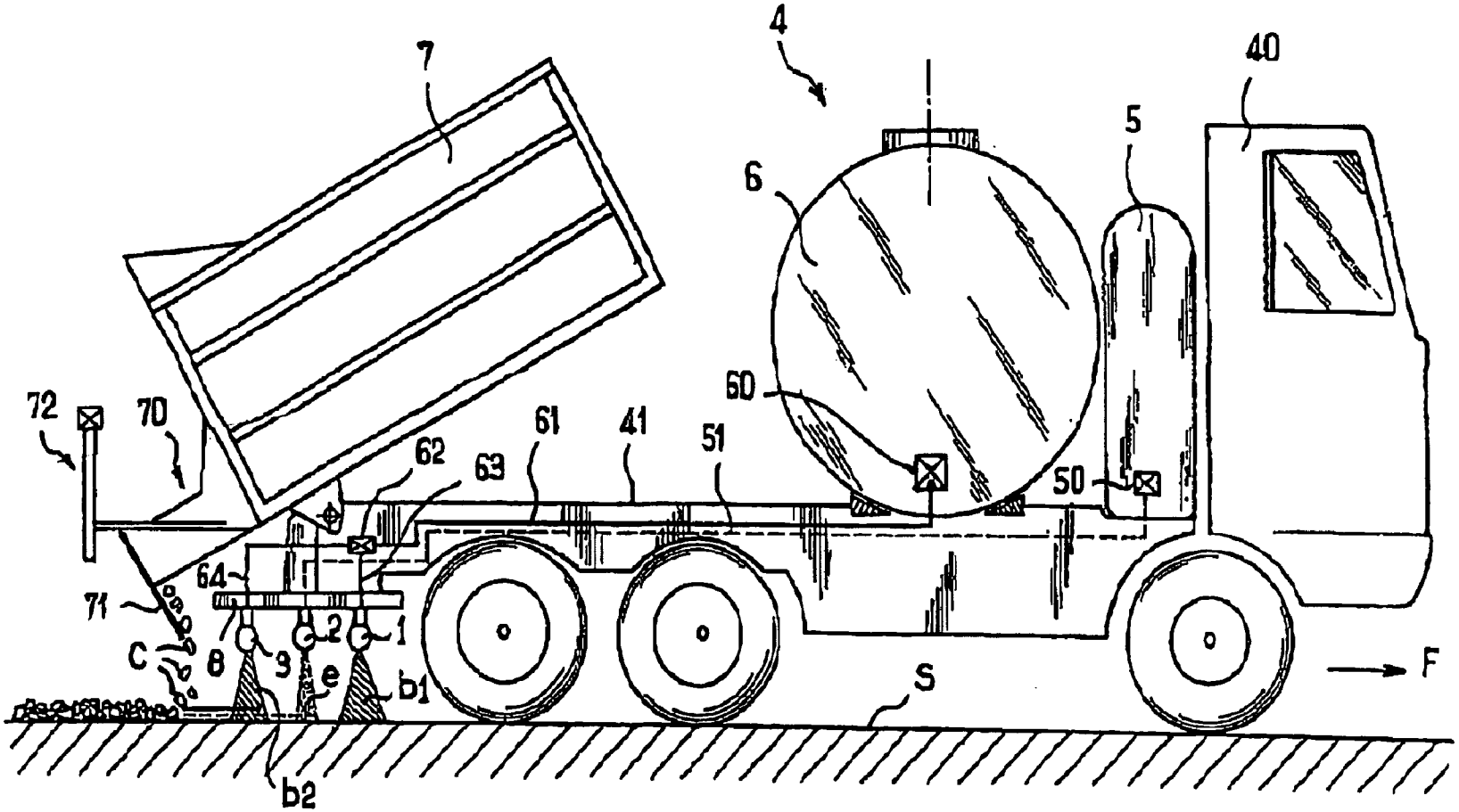

The vehicle 4 diagrammatically shown in FIG. 4 allows the method that has just been described, to be implemented.

It is a vehicle of the bi-spreader type, including a driver's cabin 40 and a chassis 41, the latter bearing in the front part a bitumen tank 6 and in the rear part an articulated tipper 7.

The tank 6 is heat-insulated and contains a bitumen which is for example at a temperature of about 130° C.

The tipper 7 contains chippings or loose stones. It is articulated on the chassis at the base of its rear part, and comprises chipping dispensing means 70, spreading being carried out in a conventional way, by using a flap 71 which allows the chippings to be distributed homogeneously as they fall onto the roadway S.

Devices of this type are described for example in the documents FR-B-2 528 085, FR-A-1 200 883 and FR-A-2 538 014.

The rear of the tipper is also fitted with a walkway 72, which, in a known way, is adapted to receive an operator.

In accordance with the invention, the chassis 41 additionally supports a tank 5 intended to contain hot water.

In the example shown, this tank is located between the cabin 40 and the bitumen tank 6.

The tank 5 is also heat-insulated and allows the water it contains to be kept at a temperature close to 100° C.

It is considered that this vehicle is adapted to work in the direction of its forward movement symbolised by the arrow F.

Just in front of the flap 71 is placed an assembly of three booms 1, 2, 3.

Booms 1 and 3 are adapted to dispense bitumen $b_1$, $b_2$ from the tank 6.

This dispensing is carried out by appropriate means of known type.

In FIG. 4 has been shown a stop valve 60 located at the outlet of the tank 6, a dispensing pipe 61, a feed regulation and distribution valve 62, and a pair of secondary pipes 63, 64, which feed each of the booms 1, 3 respectively.

By means of the feed regulation valve 62, the flow rates of the jets emitted by each of the booms 1, 3 can be varied if necessary.

The hot water dispensing boom 2 is located between the two booms 1 and 3.

It is fed from the tank 5 via a conduit 51, upstream of which is located a stop and feed regulation valve 50.

Thus, depending on working conditions it is possible to adjust the flow rate of each valve individually.

The loose stone flow rate may also be adjusted by appropriate means of known type with which the dispensing device 70 is fitted.

It goes without saying that in the possible event of two bitumens of different qualities being used, the vehicle is fitted with two tanks 6 each containing one bitumen.

In the event of a vehicle being used which operates in reverse motion, the booms 1-2-3 are placed to the rear of the chipping dispenser means 70, and their arrangement is reversed (boom 1 to the rear of booms 2 and 3).

The normal working speed of such a vehicle is about 1 meter/second.

By way of example, the bitumen is spread at a proportion of between 0.5 and 2.5 kg/m$^2$; the water is proportioned at between 5 and 300 g/m$^2$.

The particle size distribution of the chippings has a value of between 2/4 mm and 10/14 mm.

What is claimed is:

1. Method for applying a surface coating by the synchronous spreading of bonding agent and chippings onto a roadway, the method comprising:

a) a first layer of hot bitumen ($b_1$), at a temperature above 100° C., is spread onto the roadway (S);

b) depositing a film of hot water onto the first layer of hot bitumen;

c) spreading a second layer of hot bitumen, at a temperature above 100° C., onto the film of hot water;

d) spreading a layer of chippings (c), over the layers of bitumen and water.

2. Method according to claim 1, characterised in that bitumen taken to a temperature close to 130° C. and water taken to a temperature close to 100° C. are used.

3. Method according to claim 1 or claim 2, characterised in that the chippings are spread less than two seconds and, preferably, less than one second after the second layer of bitumen is spread.

4. Method according to claim 1, characterised in that the total spreading time is less than about four seconds.

5. Vehicle for applying a surface coating by synchronous spreading of bonding agent and chippings onto a roadway, with the chassis (41) bearing a hot bitumen tank (6) and a tipper (7) containing chippings (c), this vehicle being fitted with a first boom (1) for dispensing hot bitumen ($b_1$), which in placed in front—considering the forward operational movement (F) of the vehicle (4)—of a chipping spreader device (70), characterised in that the chassis (41) additionally bears a hot water tank (5), the vehicle being fitted with a second boom (3) for dispensing hot bitumen ($b_2$), also placed in front of said chipping spreader device (70), and with a hot water (a) spray boom (2) placed between the two bitumen dispensing booms (1; 3).

* * * * *